US006293780B1

(12) United States Patent
Rijkers

(10) Patent No.: US 6,293,780 B1
(45) Date of Patent: Sep. 25, 2001

(54) VIBRATING DEVICE FOR PROCESSING A FLOOR LAYER

(75) Inventor: Wilhelmus Cornelis Henricus Maria Rijkers, Lommel (BE)

(73) Assignee: B-Mac, besloten vennootschap met beperkte aansprakelijkheid, Hamont-Achel (BE)

( * ) Notice: Subject to any disclaimer, the term of this patent is extended or adjusted under 35 U.S.C. 154(b) by 0 days.

(21) Appl. No.: 09/463,416

(22) PCT Filed: Jul. 28, 1998

(86) PCT No.: PCT/BE98/00116

§ 371 Date: Feb. 4, 2000

§ 102(e) Date: Feb. 4, 2000

(87) PCT Pub. No.: WO99/07940

PCT Pub. Date: Feb. 18, 1999

(30) Foreign Application Priority Data

Aug. 5, 1997 (BE) ..... 9700661
Mar. 24, 1998 (BE) ..... 9800228

(51) Int. Cl.[7] ..... E01C 19/40; E04G 21/10

(52) U.S. Cl. ..... 425/456; 404/98; 404/114; 425/470

(58) Field of Search ..... 425/456, 470; 404/98, 114

(56) References Cited

FOREIGN PATENT DOCUMENTS

819621 * 9/1957 (GB) .

* cited by examiner

*Primary Examiner*—James P. Mackey
(74) *Attorney, Agent, or Firm*—Bacon & Thomas, PLLC

(57) ABSTRACT

A vibrating device for processing a floor layer. The device includes a vibrating board, a vibrating mechanism and a handle. The handle is attached to the vibration board with at least one clamping coupling. The clamping coupling includes at least two connecting elements, each having conical parts wherein one of the conical parts is adapted to fit within another of the conical parts. The clamping coupling further includes a tensioning device that is arranged to axially tighten the conical parts against each other.

13 Claims, 6 Drawing Sheets

VIBRATING DEVICE FOR PROCESSING A FLOOR LAYER

BACKGROUND OF THE INVENTION

This invention relates to a vibrating device for processing a floor layer, more particularly a so-called vibrating beam which comprises a vibrating unit with a vibrating board and a vibrating mechanism cooperating with this vibrating board, and a handle which is attached to the vibrating unit.

BRIEF SUMMARY OF THE INVENTION

Such vibrating devices are applied for spreading and smoothening of hardenable materials when forming a floor layer, more particularly materials such as concrete and similar.

The invention aims at a vibrating device of the above-mentioned type whereby the handle can be easily adjusted under a random inclination and thereby be adapted to the user. Hereby, the invention also aims at a coupling between the handle and the other components which, on one hand, is rapidly adjustable but, on the other hand, is very resistive against vibrations, in such a manner that the handle, once that it is adjusted in the desired position, will not become loose during the working of the vibrating device.

To this aim, the handle is attached to the vibrating unit by means of at least one clamping coupling which, in uncoupled position, allows to adjust the inclination of the handle, whereby this clamping coupling consists of, on one hand, at least two connecting elements with conical parts fitting into each other, which are connected to the handle and to the vibrating unit, respectively, and, on the other hand, of tensioning means with which the aforementioned elements can be tensioned against each other axially with their conical parts.

The invention has as an additional object to provide a vibrating device of the aforementioned type whereby the handle forms as little an obstruction as possible and requires little additional space during transport or storage of the vibrating device.

According to the invention, this aim is achieved in that the handle comprises two sticks which each are connected to the vibrating unit by means of a clamping coupling, as described heretofore, whereby the clamping coupling, in uncoupled position, allows to pivot the stick, at least between a first position in which it is directed inclined upward away from the vibrating unit when the vibrating board rests upon the floor layer to be processed, and a second position in which it extends sideward.

"Upward" has to be regarded in respect to the vibrating device as it is placed upon the floor layer to be processed, whereas "sideward" also has to be regarded in respect to the vibrating unit. Thus, inclined upward is in the direction of the operator who moves the vibrating unit along, for example, pulls it along while walking backward. The vibrating board extends with its longitudinal direction perpendicular to the handle and, thus, is directed with its both extremities sidewards.

The second position preferably is the position in which the stick is situated up to practically upon or alongside the vibrating board.

Preferably, the hinge axes of both hinge couplings are directed inclined upon the longitudinal direction of the vibrating board. The stick, which is attached with a hinge coupling, itself preferably is also directed inclined in respect to the hinge axis of this hinge coupling.

Thereby, the hinge axes may be directed horizontal, or even inclined, in respect to the horizontal plane, this is the plane of the underside of the vibrating board.

BRIEF DESCRIPTION OF THE DRAWING

With the intention of better showing the characteristics according to the invention, hereafter, as an example without any limitative character, two preferred forms of embodiment are described, with reference to the accompanying drawings, wherein.

DETAILED DESCRIPTION OF THE INVENTION

Figure 1:
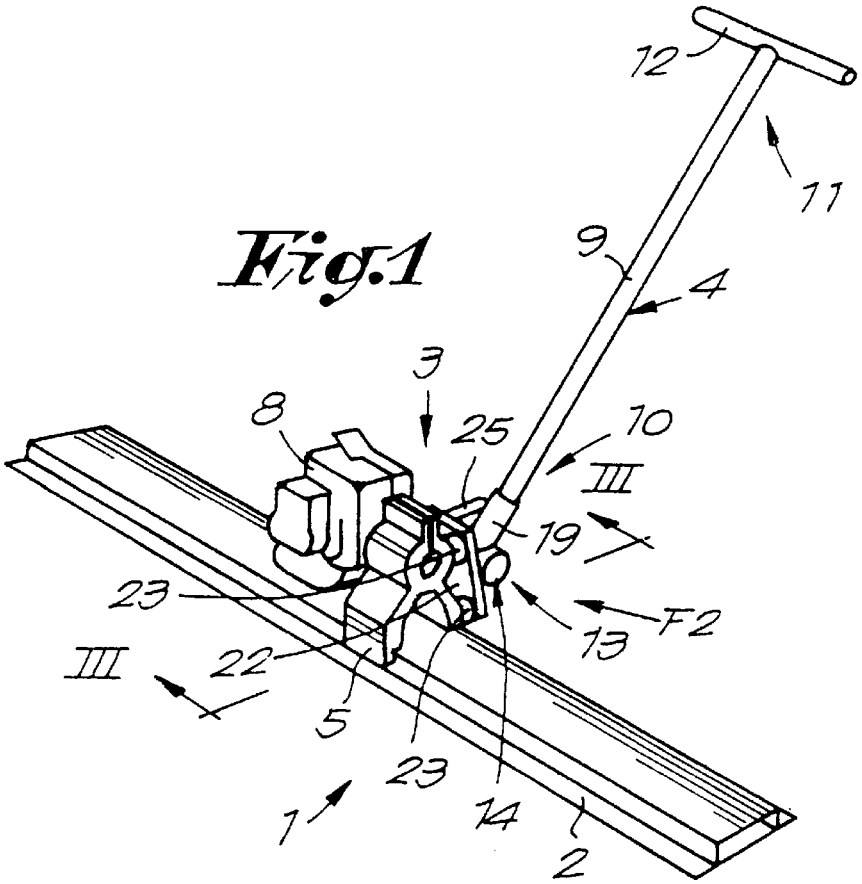
FIG. 1, in perspective, schematically represents a vibrating device according to the invention.

As represented in the FIGS. 1 to 4, the vibrating device of the invention substantially consists of a vibrating unit 1 with a vibrating board 2 and a vibrating mechanism 3 cooperating with the vibrating board 2, and a handle 4 attached to this vibrating unit 1.

Hereby, the vibrating mechanism 3 in a known manner consists of a housing 5 in which, by means of two bearings 6, a body 7 with disbalance, for example, a roll which is flattened on one side, is beared, and a motor 8 for driving this body 7.

The handle 4 substantially consists of a stick 9 which is coupled at its lower extremity 10 to the vibrating unit 1, in the represented example, to the housing 5 of the vibrating mechanism 3, and which is provided with a handhold 12 at its upper extremity 11.

The particularity of the invention consists in that the handle 4 is attached at the housing 5 by means of a clamping coupling 13 which, in uncoupled position, allows to regulate the angle of the handle 4, whereby this clamping coupling 13 consists of, on one hand, at least two connecting elements 14–15 with conical parts 16–17 fitting into each other which are connected to the handle 4 and to the housing 5, respectively, and, on the other hand, of tensioning means 18 which allow to tension the aforementioned elements 14–15 with their conical parts 16–17 axially against each other.

Apart from the already mentioned conical part 16, the element 14 which is connected to the handle 4 consists of a seat 19 for the stick 9. The conical part 16 extends perpendicular to the seat 19 and consists of a part with an externally conical surface 20.

The element 15 is externally cylindrical and is provided with an internally conical surface 21. In the represented example, this element 15 is attached, for example, welded, upon a plate 22 which is fixed, by the intermediary of damping elements 23 and screws, on the housing 5 of the vibrating mechanism 3.

Figure 3:
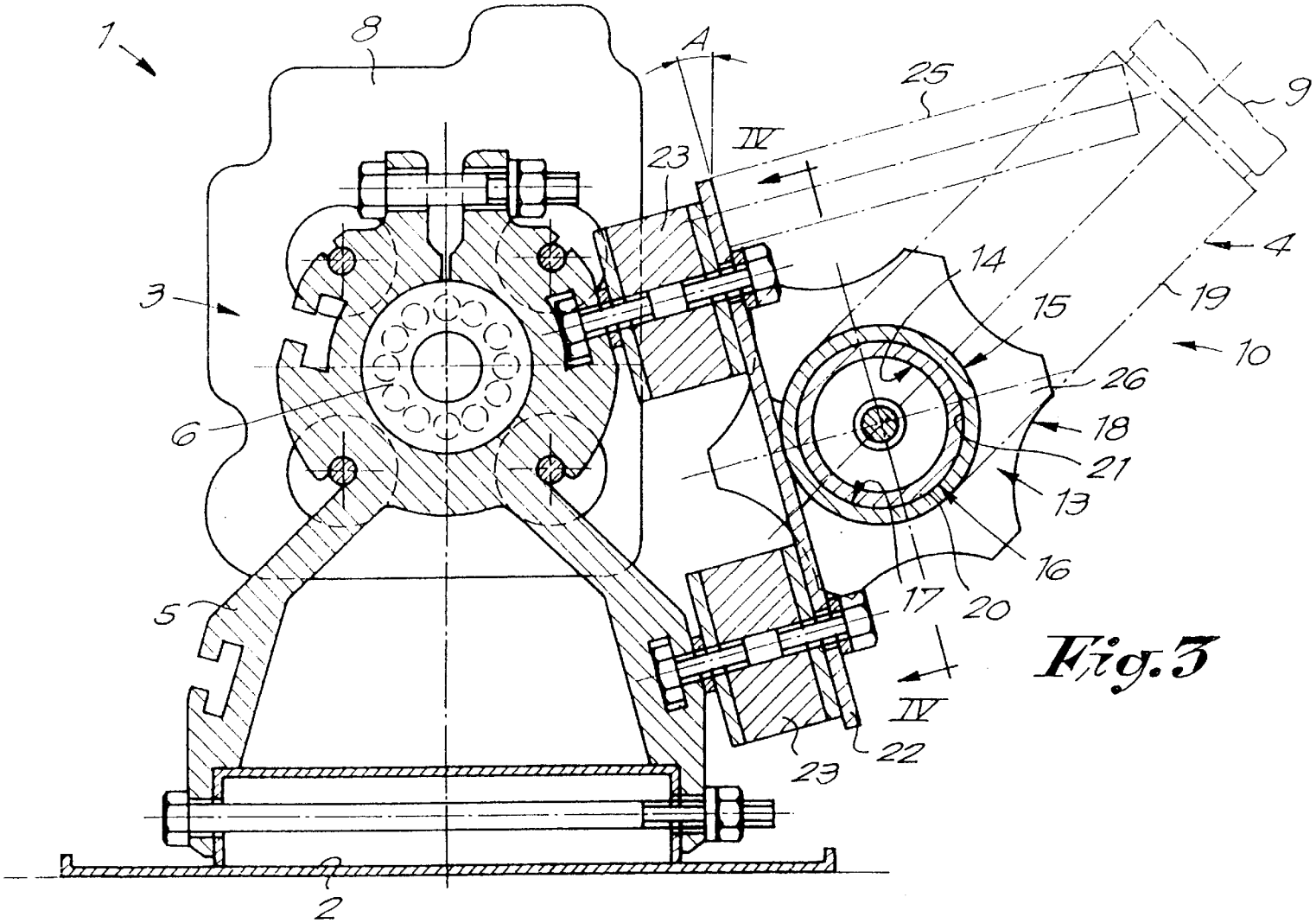
FIG. 3 represents a cross-section according to line III—III in FIG. 1.

The plate 22 is inclined under an angle A which, in the represented example, is approximately 15° in respect to the vertical or the perpendicular to the underside of the vibrating board 2, as represented in FIG. 3.

In this form of embodiment, the geometrical hinge axis 24 of the two cooperating elements 14 and 15 is parallel to the longitudinal direction of the vibrating board 2.

A handle 25 may be attached at the plate 22 for lifting and carrying the vibrating device.

The aforementioned tensioning means 18 substantially consist of screw means with a turning knob 26 for manual tensioning, loosening respectively, of the handle 4. Hereby, the turning knob 26 can be screwed in axially in respect to one of the aforementioned elements, in this case, the element 14, in such a manner that, with its interior side 27, it can exert a pressure onto the other element 15.

In the example represented in the FIGS. 1 to 4, the tensioning means 18 are also provided with an elastically compressible element cooperating with the screw means, in this case, a saucer spring 28 provided under the turning knob 26, in such a manner that, by tightening it, the tension force in the clamping coupling 13 can be gradually increased.

In this manner, also a constant pressing-on force is guaranteed which prevents the coming loose of the conical parts 16–17 due to vibration. Hereby, it is noted that the vibration force generated by the body 7 propagates until into the clamping coupling, with the consequence that the axial clamping of the conical parts 16–17 is enhanced, this because the saucer spring 28 vibrates the conical parts 16–17 by means of it s constant pressing-on force more stable into each other.

It is noted that a self-loosening conical coupling can be applied at the parts 16–17. In this manner, it is achieved that, by applying the saucer spring 28 in the clamped position, a more stable vibrating into each other is obtained, whereas in loosened position, the conical parts 16–17 may easily be taken apart.

Figure 4:
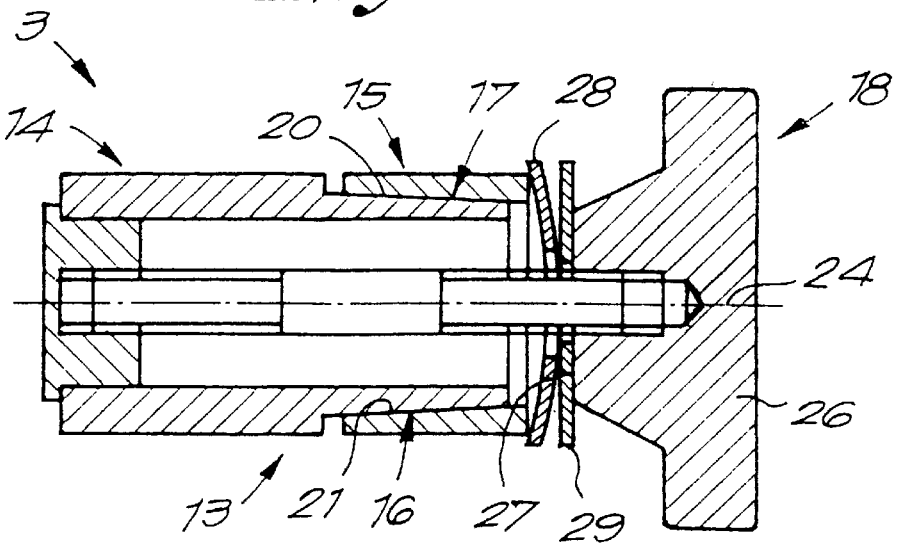
FIG. 4 represents a cross-section according to line IV—IV in FIG. 3.
Figure 2:
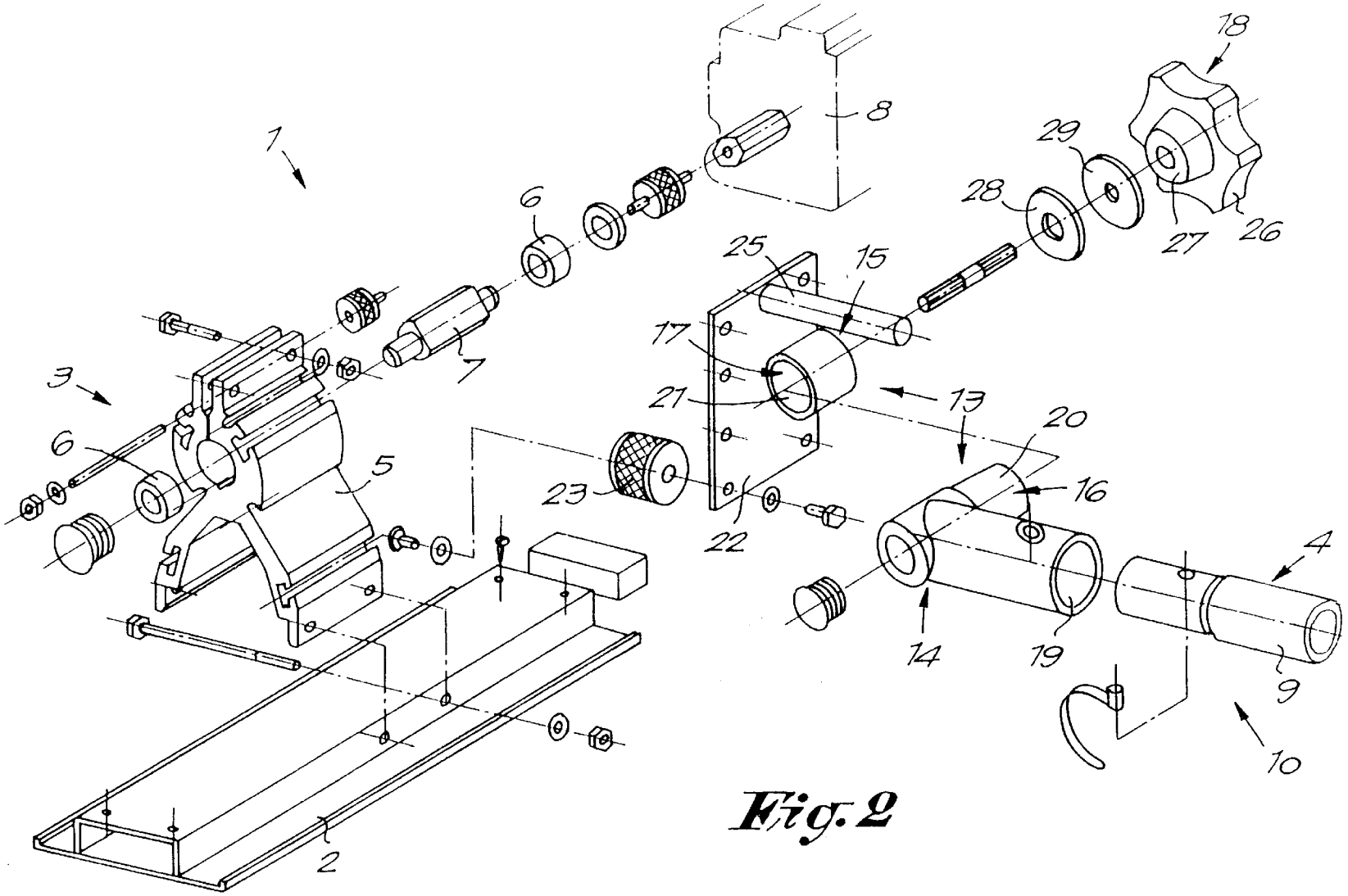
FIG. 2 represents the part which is indicated by arrow F2 in FIG. 1, in exploded view.

As represented in FIG. 4, a classical washer 29 can also be provided between the turning knob 26 and the saucer spring 28, or, according to a variant, a ring milled at its surface may be provided.

The working of the clamping coupling 13 can easily be deduced from the figures. By unscrewing the turning knob 26, the clamping coupling 13 is uncoupled or, in other words, the axial tension force between the conical parts 16 and 17 is taken away, as a result of which the handle 4 can be turned freely.

By holding the handle 4 at a desired angle and subsequently screwing the turning knob 26 tight, the conical parts 16–17 are tensioned axially, as a result of which a clamping is created. By tensioning the turning knob 26 in a sufficient manner, it is obtained that the handle 4 remains in the adjusted angle.

Due to the fact that use is made of conical parts 16–17 with a circular cross-section, the handle 4 may be adjusted at any desired angle.

Due to the presence of the saucer spring 28, the tension force can be continuously regulated. This saucer spring 28, or any other elastic element, also offers the advantage that the coupling during the use of the vibrating device is especially resistive against vibrations, in other words, does not become loose due to vibrations, and that, as aforementioned, the conical parts 16–17 even are vibrated more stable into each other.

It is noted that the handle 4 does not necessarily have to be coupled to the housing 5, but according to a variant, the clamping coupling 13 may also be provided directly between, for example, the vibrating board 2 and the handle 4.

It is also possible to apply several clamping couplings 13, for example, when the handle should be fork-shaped and is coupled to the vibrating board 2 at two places situated apart from each other, or when, as represented in the FIGS. 5 to 8, the handle 4 is double and, thus, comprises two sticks 9.

Both sticks 9 are attached at the vibrating unit 1 by means of a clamping coupling 13, but this clamping coupling 13 differs from the clamping coupling 13 described heretofore in that the two elements 14 and 15 with the conical parts 16 and 17 are interchanged or, in other words, in that the element 14 with the part 16 with an externally conical surface 20 now is attached to the housing 5, whereas the element 15 with the part 17 with an internally conical surface 21 is connected to a stick 9.

As the sticks 9 and, thus, also the clamping couplings 13 are situated at a relatively large distance to each other, the elements 14 furthermore cannot be fixed directly on the plate 2, but are connected to this plate 22 by the intermediary of a profile strip 30 screwed thereupon.

The plate 22 is inclined, as in the form of embodiment of the FIGS. 1 to 4, with an angle A in respect to the perpendicular on the underside of the vibrating board 2.

Figure 7:
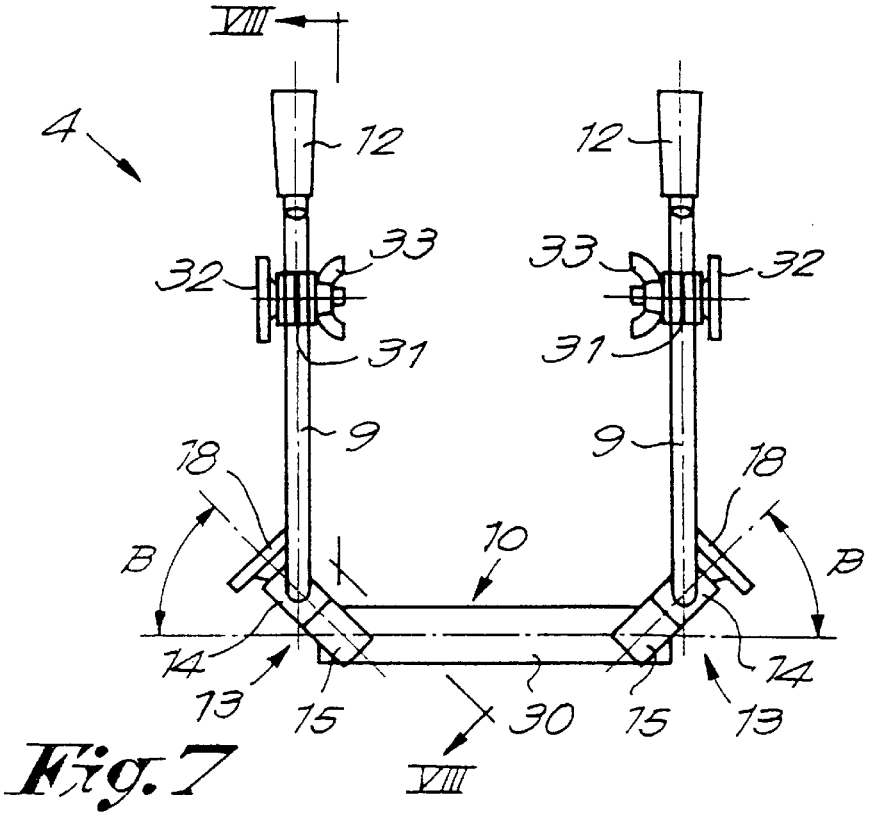
FIG. 7 represents a view according to F7 in FIG. 6.

The hinge axis 24 of the two cooperating elements 14 and 15 of the clamping coupling 13 on each extremity of the profile strip 30 is inclined with the same angle A in respect to the plane of the underside of the vibrating board 2, with which plane the vibrating board 2 during use rests upon the floor layer to be processed. Furthermore, these hinge axes 25 are not directed parallel to the longitudinal direction of the vibrating board 2, such as in the form of embodiment according to FIGS. 1 to 4, but form an angle B therewith, such as represented in FIG. 7. More particularly do the hinge axes 24 of the clamping couplings 13 form such angles with this longitudinal direction and, thus, with the longitudinal direction of the profile strip 30, that they diverge from each other in the direction towards the turning knobs 26. In the represented example, these angles are 45°.

Figure 8:
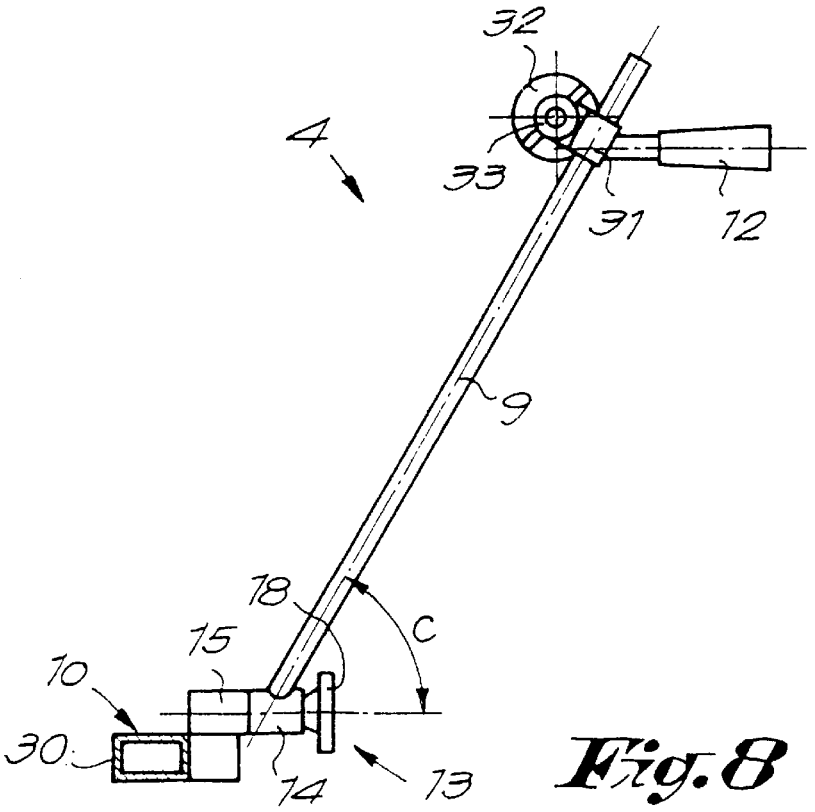
FIG. 8 represents a cross-section according to line VIII—VIII in FIG. 7.

Each of the sticks 9 is fixed, for example, welded, with its lowermost extremity directly to an element 15 but is inclined backward, thus, in the direction of the turning knob 26 in respect to the aforementioned geometrical axis of the cooperating elements 15 and 16. In the represented example, each stick 9 forms an angle C of approximately 60° with the aforementioned geometrical axis, as represented in FIG. 8.

In any case, the aforementioned angles A, B, and C are such that, when the two sticks 9 of the double handle 4 are pivoted downward, as represented in FIG. 7, they are directed sidewards with their free extremity practically in the prolongation of the vibrating board 2, which offers the additional advantage that the device then takes up little space for storage or transport.

Each stick 9 of the handle 4 also comprises a separate handlebar 12 which in this form of embodiment is adjustable in height and direction.

To this aim, each handlebar 12 comprises at one extremity a clip 31 which can be clamped around the stick 9 by means of a bolt 32 fixed through the arms of the clip 31 with a knurled head and a nut 33 screwed upon this bolt 32.

Figure 5:
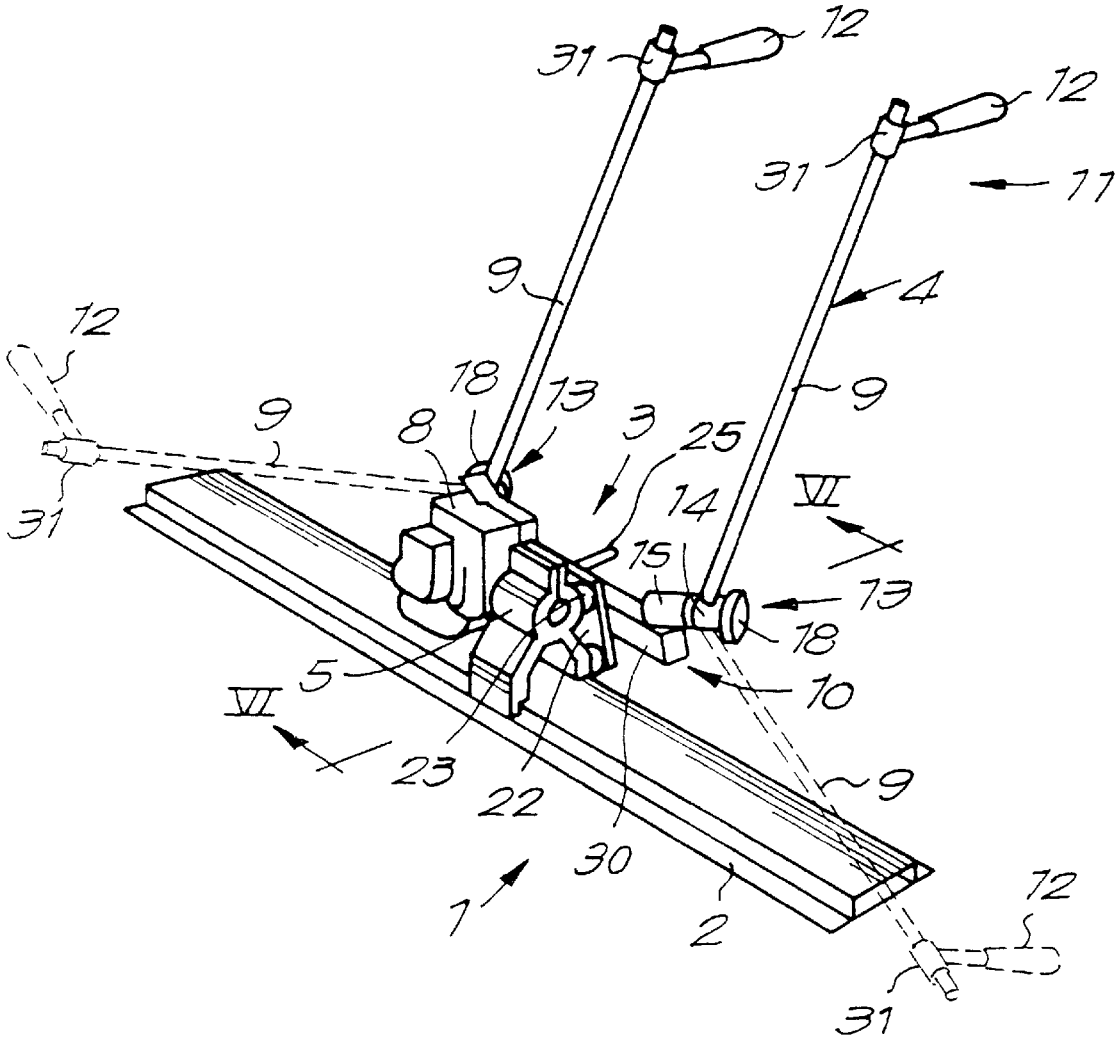
FIG. 5 represents a view in perspective, analogous to that from FIG. 1, but for another form of embodiment.
Figure 6:
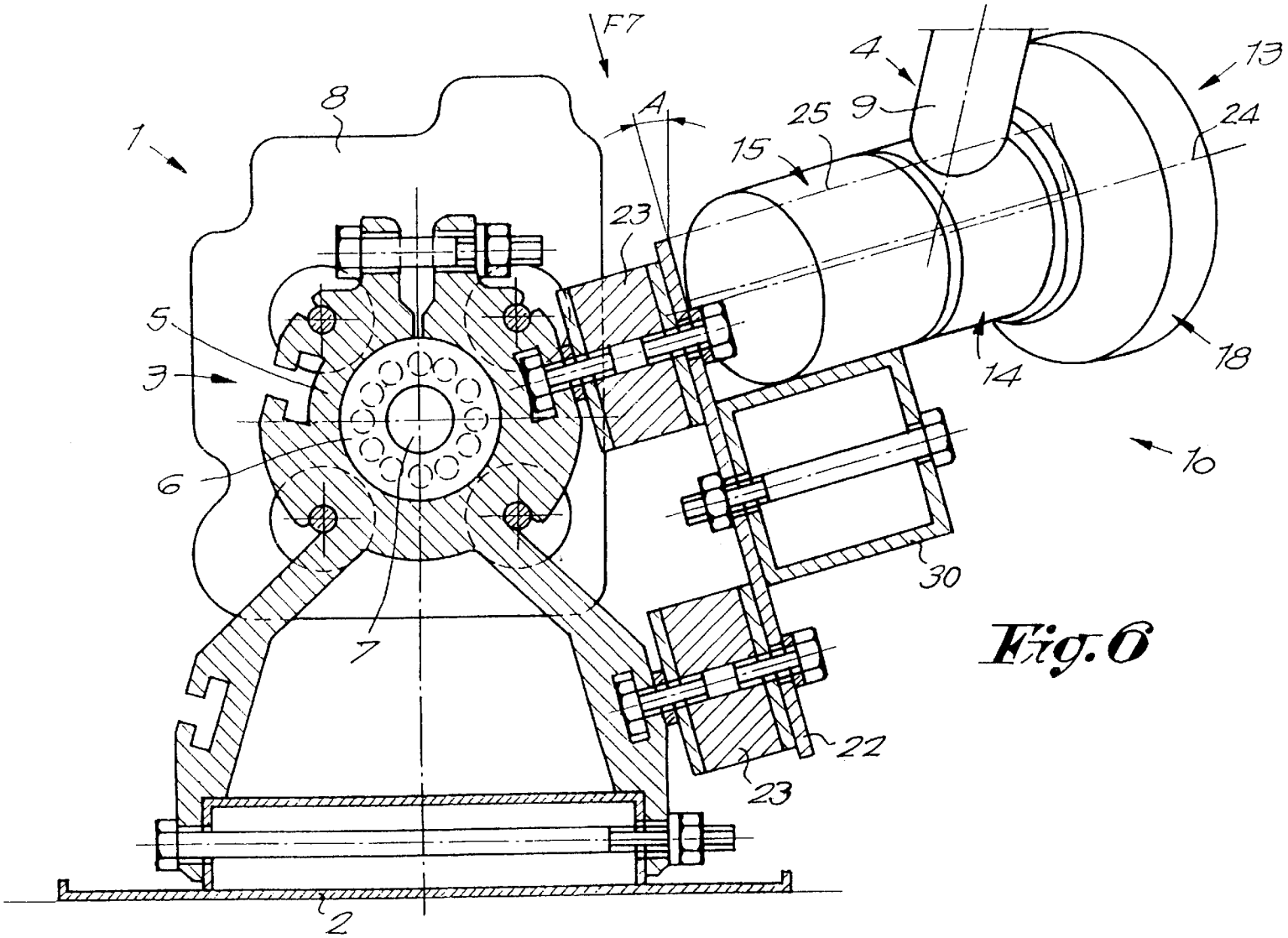
FIG. 6 represents a cross-section according to line VI—VI in FIG. 5.

In order to change the position of the double handle 4 or tilt it downward into the position represented in dashed line in FIG. 5, it suffices to loosen the turning knob 26 of each of both clamping couplings 13 and tighten it again after obtaining the new position.

During the use of the vibrating device, whereby the vibrating board 2 is placed upon the floor layer to be processed, the two sticks 9 are directed inclined upward, as represented in FIG. 5 in full line.

Hereby, the two sticks 9 can be placed into a position whereby they are directed practically parallel to each other. In respect to the horizontal plane, and more particularly the floor layer upon which the vibrating board 2 rests, these sticks 9 then are directed inclined upward and towards the operator of the vibrating device, with an angle which is the sum of the angles A and C, in the represented example approximately 75°.

In consideration of transportation, each of the sticks 9, after unscrewing the corresponding turning knob 26, can be pivoted outward around the hinge axis 24 downward.

Due to the fact that this hinge axis 24 is directed inclined in respect to the longitudinal direction of the vibrating board 2 under the aforementioned angle B and the stick 9 itself, under the aforementioned angle C, is directed inclined in respect to this hinge axis 24 whereas the hinge axis 24 forms an angle with the horizontal plane or the underside of the vibrating board 2 which is equal to the aforementioned angle A, this stick 9 moves not only downward, but also somewhat towards the vibrating board 2.

When the stick 9 is pivoted horizontally, it can extend sidewards parallel to the vibrating board 2. As the clamping coupling 13, however, is situated at a distance from the theoretical vertical plane through the center of the underside of the vibrating board 2 which rests upon an almost horizontal plane, namely, the floor layer to be processed, this stick 9 takes up even less space when it extends up to above the vibrating board 2, as in the represented example.

Due to the fact that the hinge coupling 13 is also situated at a distance above the vibrating board 2, the stick 9 then can also be pivoted downward beyond the horizontal position.

The two sticks 9 can be pivoted downward until they are directed sidewards, more or less in the longitudinal direction of the vibrating board 2, and, thus, extend alongside or preferably up to above this vibrating board 2, as a result of which the loss of space by the handle 4 is minimized and this handle 4 almost is not obstructive during transport.

The clamping couplings 13 may comprise positioning means, for example, fingers provided upon the elements 14 and 15 which come into mutual contact when the pertaining stick 9 has reached the desired position when being tilted upward.

It is obvious that the aforementioned elements 14–15 with a conical part can be manufactured either in one piece or not with the stick 9, the vibrating unit 1, respectively.

The present invention is in no way limited to the forms of embodiment described by way of example and represented in the figures, on the contrary may such vibrating device be realized in various forms and dimensions without leaving the scope of the invention.

What is claimed is:

1. A vibrating device for processing a floor layer comprising:

a vibrating unit including a vibrating board and a vibrating mechanism cooperating with the vibrating board;

a handle attached to the vibrating unit; and at least one clamping coupling connecting said handle to said vibrating unit, wherein in an uncoupled position said clamping coupling permits adjustment of the inclination of the handle, said clamping coupling including at least two connecting elements each having a conical part wherein one of said conical parts is adapted to fit within another of said conical parts to connect the handle and the vibrating unit, said clamping coupling further including a tensioning device arranged to axially tighten said conical parts against each other.

2. The vibrating device according to claim 1, wherein the tensioning device comprises a screw.

3. The vibrating device according to claim 2, wherein the screw includes a turning knob.

4. The vibrating device according to claim 1, wherein the tensioning device comprises at least one elastically compressible element.

5. The vibrating device according to claim 4, wherein the elastically compressible element is a saucer spring.

6. The vibrating device according to claim 3 wherein the turning knob is arranged in axial relationship with said connecting elements, said at least one elastically compressible element disposed between the turning knob and one of said connecting elements.

7. The vibrating device according to claim 3 wherein a damping element is positioned between said vibrating unit and a first connecting element.

8. The vibrating device according to claim 1 wherein the handle comprises a stick, said clamping coupling positioned at one end of said stick.

9. The vibrating device according to claim 2 wherein another connecting element connects to the handle and further comprises a seat connecting to said stick, said conical part of said another connecting element forming an externally conical surface extending perpendicular to said seat, said first connecting element having a body forming an internally conical surface.

10. The vibrating device according to claim 3 wherein said handle comprises two sticks each connected to said vibrating unit by said at least one clamping coupling, wherein an uncoupled position said clamping coupling is adapted to permit said stick to pivot between at least a first position wherein said stick extends at an incline with respect to the longitudinal axis of the vibrating board resting upon a floor layer, and a second position wherein said stick extends sidewards, upon or alongside the vibrating board.

11. The vibrating device according to claim 10 wherein each clamping coupling includes a hinge axis directed inclined with respect to the longitudinal direction of the vibrating board.

12. The vibrating device according to claim 11 wherein said stick is attached to a clamping coupling connected to said vibration device, said stick adapted to be positioned at an incline with respect to said hinge axis.

13. The vibrating device according to claim 12 wherein said vibrating board has an underside, and wherein said hinge axis extends at an incline with respect to a plane including the underside of the vibrating board.

* * * * *